US006595140B1

(12) United States Patent
Madison et al.

(10) Patent No.: US 6,595,140 B1
(45) Date of Patent: Jul. 22, 2003

(54) RAILWAY TIE PLATE INSERTION APPARATUS AND METHOD

(75) Inventors: Harry Madison, Mt. Pleasant, SC (US); Christian Glen Brand, Fairmont, MN (US)

(73) Assignee: Harsco Technologies Corporation, Fairmont, MN (US)

( * ) Notice: Subject to any disclaimer, the term of this patent is extended or adjusted under 35 U.S.C. 154(b) by 0 days.

(21) Appl. No.: 10/164,037

(22) Filed: Jun. 5, 2002

(51) Int. Cl.[7] ..... E01B 29/00
(52) U.S. Cl. ..... 104/16
(58) Field of Search ..... 104/16, 2, 17.1, 104/17.2; 294/55.5; 254/131

(56) References Cited

U.S. PATENT DOCUMENTS

| | | | | |
|---|---|---|---|---|
| 3,069,687 A | * | 12/1962 | Rowe | 104/2 |
| 3,882,785 A | * | 5/1975 | Rowe | 104/16 |
| 4,280,613 A | | 7/1981 | Stewart | |
| 4,554,624 A | * | 11/1985 | Wickham et al. | 702/33 |
| 4,733,614 A | | 3/1988 | Mohr et al. | |
| 4,770,103 A | | 9/1988 | Allmer | |
| 4,942,822 A | | 7/1990 | Cotic | |
| 5,067,412 A | | 11/1991 | Theurer et al. | |
| 5,193,461 A | | 3/1993 | Theurer et al. | |
| 5,305,692 A | | 4/1994 | Madison et al. | |
| 5,331,899 A | | 7/1994 | Holley | |
| 5,419,259 A | | 5/1995 | Theurer et al. | |
| 5,584,247 A | * | 12/1996 | Almaraz et al. | 104/2 |
| 5,655,455 A | * | 8/1997 | Smith | 104/16 |
| 5,722,325 A | | 3/1998 | Glomski et al. | |
| 5,839,377 A | | 11/1998 | Brenny et al. | |
| 6,170,401 B1 | | 1/2001 | Miller et al. | |

* cited by examiner

*Primary Examiner*—Mark T. Le
(74) *Attorney, Agent, or Firm*—William F. Lang, IV; Eckert Seamans Cherin & Mellott, LLC

(57) ABSTRACT

A railway tie plate insertion vehicle includes operator's chairs mounted on both sides of the vehicle; with the occupants of each chair being provided with a tie plate insertion wand including controls for movement of the vehicle. A tie magazine deposits a tie plate on the tie upon actuation by the operator when a tie plate has not been previously deposited. A first rail clamp includes a pair of rollers for engaging the rail, attached to the ends of a pair of scissor arms, so that raising the rail draws the scissor arms closer together, increasing the gripping pressure on the rail. A similar rail clamp is located at the rear of the vehicle, which also includes an electrical connection for the operator's wand, thereby permitting tie plate insertion from the rear of the vehicle when obstacles are present along the sides of the vehicle.

13 Claims, 10 Drawing Sheets

RAILWAY TIE PLATE INSERTION APPARATUS AND METHOD

BACKGROUND OF THE INVENTION

1. Field of the Invention

The present invention provides an apparatus and method for replacing the tie plates of a railway.

2. Description of the Related Art

The rails of a railroad track are usually secured to cross ties by spikes driven into tie plates, with the tie plates located between the rail and the tie, and the head of the spike overlapping the bottom of the rail. The tie plates block lateral movement of the rails, and anchors are attached to the rail on either side of the tie are used to secure the rail against longitudinal movement.

Railroad ties occasionally must be replaced due to wear. After a tie is replaced, tie plates must be provided between the rail and the tie so that the rail may be properly secured to the tie.

Several other references propose various systems for use in replacing tie plates. For example, U.S. Pat. No. 4,280,613, issued to J. K. Stewart on Jul. 28, 1981, describes a tie plate conveying and orienting system.

U.S. Pat. No. 4,770,103, issued to F. Allmer on Sep. 13, 1988, describes a rail clamp. The rail clamp includes a pair of line-up wheels for engaging the inside edges of the rails. A pair of pivoting clamping arms, with each clamping arm having a disk rotatably mounted to its end, engages the outside edge of each rail, just below the rail's ball. Movement of the clamping arms is controlled by hydraulic cylinders. Additionally, a stabilizer cylinder connecting a bridge crossing the chassis to the rail lifting assembly may either permit the rail lifting assembly to float to correspond with the rails, or may be locked in position.

U.S. Pat. No. 4,733,614, issued to G. Mohr et al. on Mar. 29, 1988, describes a machine for repairing a railway track. The machine includes a main chassis having various devices for repairing a railway, mounted on a chain drive under a railway vehicle. A counter weight mounted to the chain drive, moving the opposite direction, counters the effects of inertia.

U.S. Pat. No. 4,942,822, issued to D. J. Cotic on Jul. 24, 1990, describes an apparatus and method for automatically setting rail tie plates. The apparatus includes a frame having a ramp thereon. The ramp stores the tie plates, and includes a control mechanism for releasing them one at a time into a plate pocket. A reciprocated pusher then moves the plate from the plate pocket to its position on the tie.

U.S. Pat. No. 5,067,412, issued to J. Theurer et al. on Nov. 26, 1991, describes a tie plate-inserting machine. The front of the machine includes a crane broom with a tie plate-collecting magnet. A funnel adjacent to the crane leads to a conveyer, which terminates above a sorting table. A roller conveyer conveys ties from the sorter to a magazine. The magazine moves between a level position for receiving tie plates from the sorting table, and a lower position for dispensing the tie. The machine includes a tie plate-inserting arm slidably supported by a guide rod, for pushing the-tie plates from the magazine to their position below the rail. A lifting roller pivots between a raised position and a lowered position for permitting tie plates to be pushed thereon from the magazine to their final position below the rail.

U.S. Pat. No. 5,193,461, issued to J. Theurer et al. on Mar. 16, 1993, describes a tie exchange mean for both removing ties and inserting new ties. The tie exchange machine may move longitudinally along a guide track. A scarifier and track-lifting device are included. A mobile tie transporting crane may move towards or away from the tie exchange device, for transporting either new ties to be installed or old ties which have been removed. The tie-depositing device is a vertically adjustable forklift.

U.S. Pat. No. 5,305,692, issued to H. Madison et al. on Apr. 26, 1994, and assigned to Harsco Corporation, the assignee of the present invention, describes a tie exchanger mounted on a truck. The tie exchanger has a rail clamp table having rail clamps and a boom. The boom includes a tie clamp, and may pivot around the vertical axis to insert ties from either side of the tracks.

U.S. Pat. No. 5,331,899, issued to J. D. Holley on Jul. 26, 1994, describes a tie plate installer and remover using a magnetic wheel to insert or remove a tie plate. The tie plate installer includes a tie magazine from which tie plates are dropped into a shoot leading to the magnetic wheel, which then carries the tie plate to a position on the tie adjacent to its final location under the rail, and finally pushes it under the rail.

U.S. Pat. No. 5,419,259, issued to J. Theurer et al. on May 30, 1995, describes a ballast stabilizer. The ballast stabilizer has a rail clamp including a roller for engaging the rail's ball, mounted on an arm secured at its other end to a lever. The opposite arm of the lever is secured to a hydraulic cylinder, so that extending the cylinder pushes inward on the clamp arm. A pair of vertical inner wheels are pushed against the gauge side of the rail's ball by hydraulic cylinders. A shaking apparatus vibrates the machine parallel to the ties.

U.S. Pat. No. 5,722,325, issued to K. E. Glomski et al. on Mar. 3, 1998, describes a tie replacement apparatus including drip elements for holding a tie plate in place while the tie underneath is replaced.

U.S. Pat. No. 5,839,377, issued to D. M. Brenny et al. on Nov. 24, 1998, describes a machine for installing and removing elastic rail clips of the type used for fastening rails to concrete or wooden ties.

U.S. Pat. No. 6,170,401, issued to R. Miller et al. on Jan. 9, 2001, describes a rail vehicle for collection and distribution of railroad cross ties.

When replacing tie plates, it is useful to position the human operator where he may observe the operation, and make corrections as necessary. Additionally, it would be helpful for an operator in this position to be able to control movement of the vehicle to which the tie plate replacement apparatus is secured, thereby permitting rapid progression from one tie plate to the next. Furthermore, it is desirable to have the ability to utilize the tie replacement apparatus from different locations on the vehicle, depending on the nature of the obstacles surrounding the vehicle, for example, platforms, bridges, etc. Accordingly, a railway tie replacement apparatus and method incorporating these features is desired.

SUMMARY OF THE INVENTION

The present invention provides a railway tie insertion vehicle. The vehicle includes an operator's chair on either side of the vehicle, with a main rail clamp and tie plate magazine located in close proximity to the operator's chair. A secondary rail clamp is located at the rear of the vehicle. Each operator is provided with a tie plate insertion wand that may be utilized from either the side or the rear of the vehicle, and which includes controls for the vehicle.

The main rail clamps are located between the wheels of the vehicle. The rollers are placed underneath the rails' ball where they roll along the rail until lifting is desired. When raising a rail is desired, lifting the clamp will cause the scissor arms to be drawn together, thereby gripping the rail and lifting it a sufficient distance to permit removal and insertion of the tie plate. Hydraulic cylinders are provided for moving the scissor arms away from the ball when unclamping the rail is desired. Additionally, a stabilizer cylinder connecting the wheel and frame assembly to the rail lifting assembly locks the rail in place laterally as the rail is raised, preventing buckling of the rail. The stabilizer cylinder also permits the operator to move the rail laterally in either direction to correct misalignment of the rail.

A secondary rail clamp, utilizing the same scissors mechanism but without the rollers, is located at the rear of the machine, permitting tie plates to be inserted from inside the tracks when the machine is used next to a platform or on a bridge, where access to the rail from the outside is restricted.

An operator's chair is provided on either side of the vehicle, with each operator also having a tie plate insertion wand with a set of vehicle controls. Each operator has the ability to propel the vehicle, apply the brakes, control the rail clamps, adjust the rail lift on their individual sides, activate the emergency stop and shut-down mechanism, and blow the vehicle's horn. The wand extends from the control box to a position adjacent the rail, wherein it may be used to manually push a tie plate under the rail. The control box attached to the wand is connected to the vehicle or electrical system through quick disconnect electrical connectors permitting it to be moved to the vehicle's rear for use with the secondary clamps.

In general, tie plate will be deposited along the rail in advance of the tie plate replacement operation, so that the operators will not normally need to utilize a tie plate transported on the vehicle. However, in the event that a tie plate is not deposited in the location where it is needed, the vehicle does include a tie plate magazine, holding the tie plates vertically stacked. When a new tie plate is needed, the operator can activate a hydraulic pusher, which pushes the bottom tie plate from the magazine onto a ramp, so that the tie plate will slide down off the vehicle, landing adjacent to the rail.

The operator will control the vehicle from its cab when travelling to and from a work location. During a tie replacement operation the movement of the vehicle can be controlled by the operators on either side of the vehicle. The vehicle will travel along the track, stopping at each location wherein the tie plate must be replaced. The operators will use the scissors clamp to raise the rail, with the stabilizer cylinder plus the rail clamp's location between the wheels of the vehicle preventing buckling of the rail while it is being lifted. The operator will use their wand to manually push the old tie plate out from under the rail. If a new tie plate has been deposited along the rail, the operator will simply use the wand to manually push the new tie plate into place. If not, then the operator will actuate the pusher for the tie magazine, driving a tie from the bottom of the magazine onto the ramp, where it will fall into position adjacent to the rail. The operator may then manually push the new tie into place, just as he would if it had been previously deposited. The operators will then,lower the rail, and move to the next tie replacement location.

BRIEF DESCRIPTION OF THE DRAWINGS

Like reference numbers denote like elements throughout the drawings.

DETAILED DESCRIPTION

The present invention provides an apparatus and method for installing new railway ties in a railway track.

Figure 4:
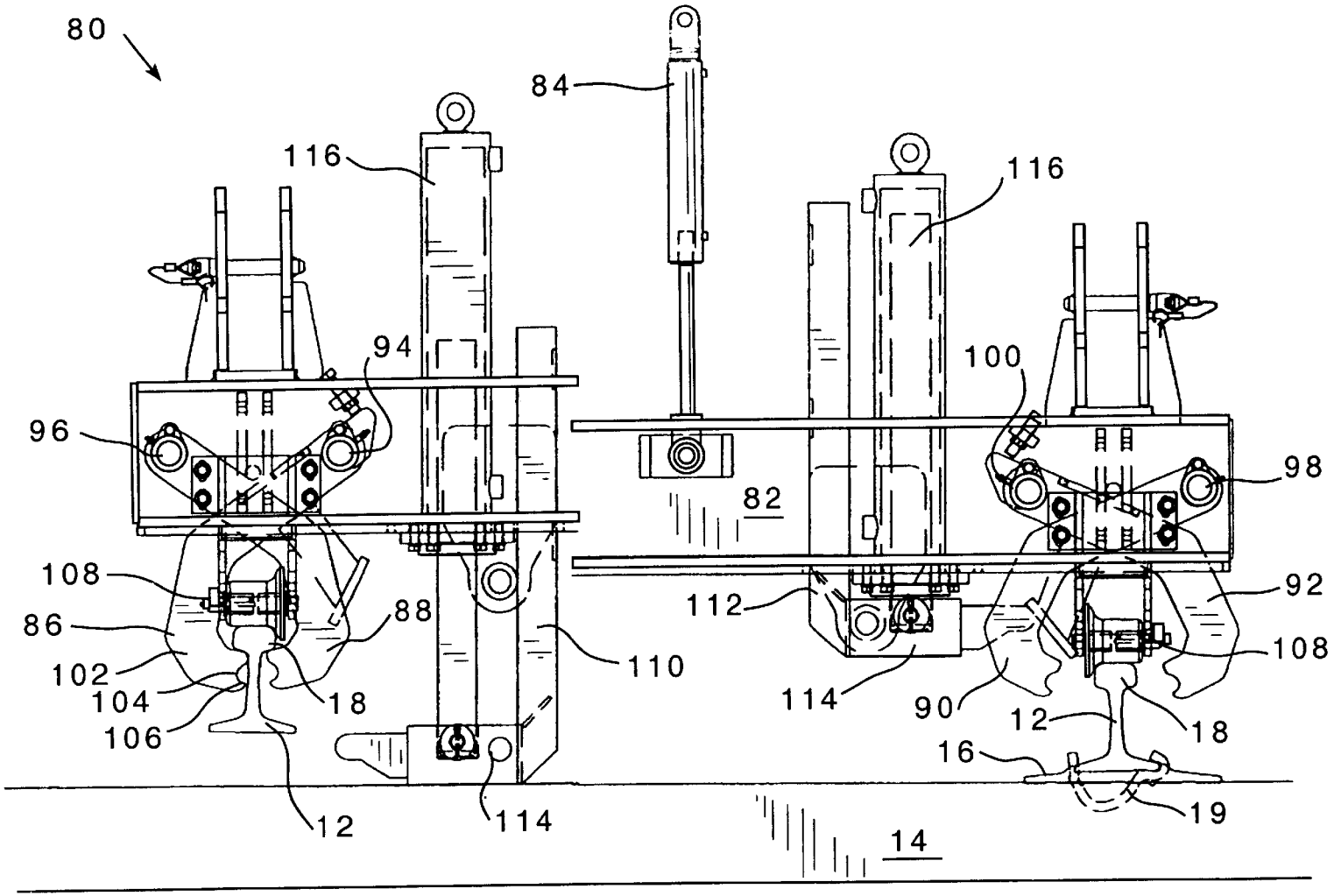
FIG. 4 is a cross-sectional front view of a rail clamp according to the present invention, illustrating one clamp in its closed position, and a second clamp in its open position.
Figure 5:
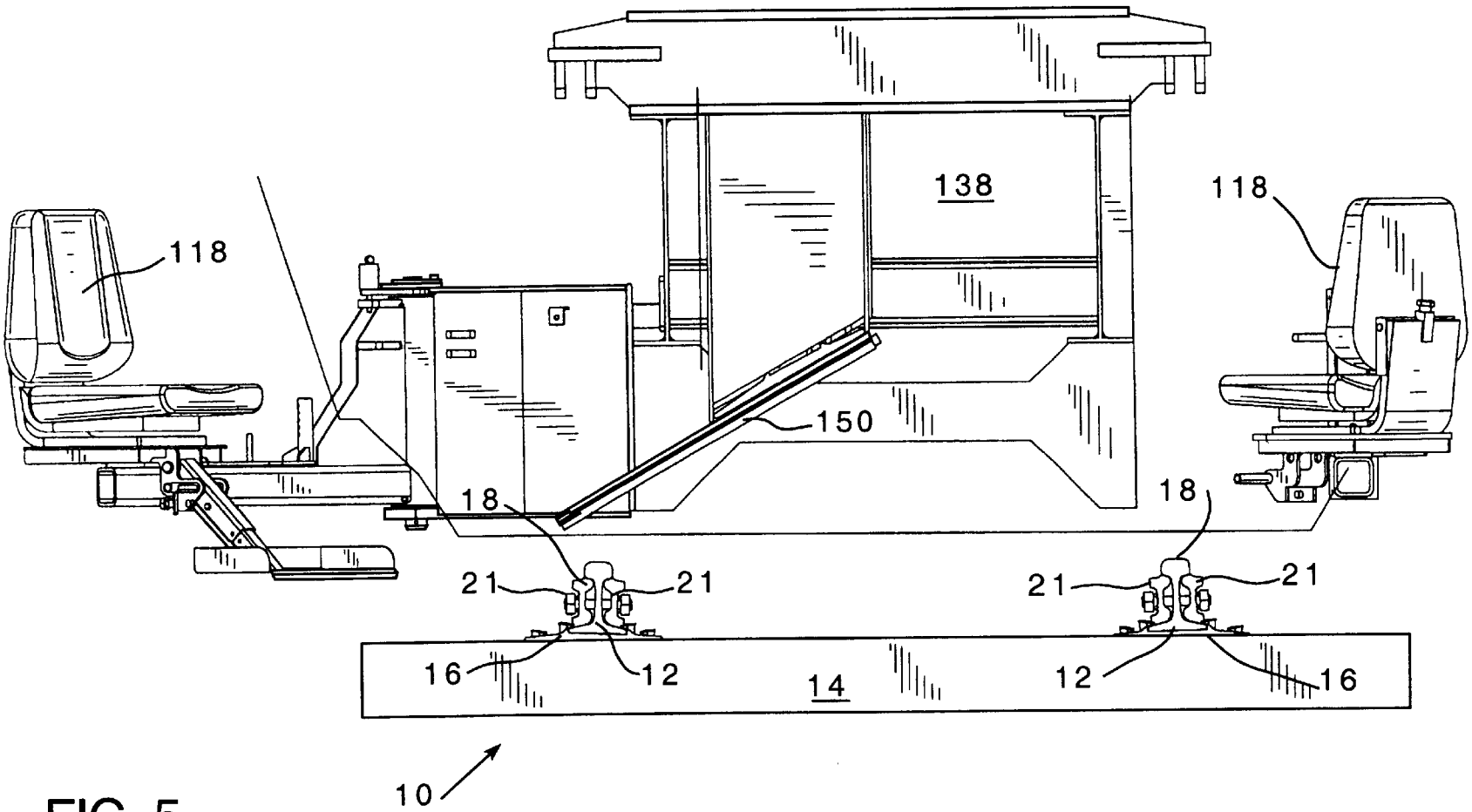
FIG. 5 is a cross-sectional front view of a tie plate insertion vehicle according to the present invention.
Figure 6:
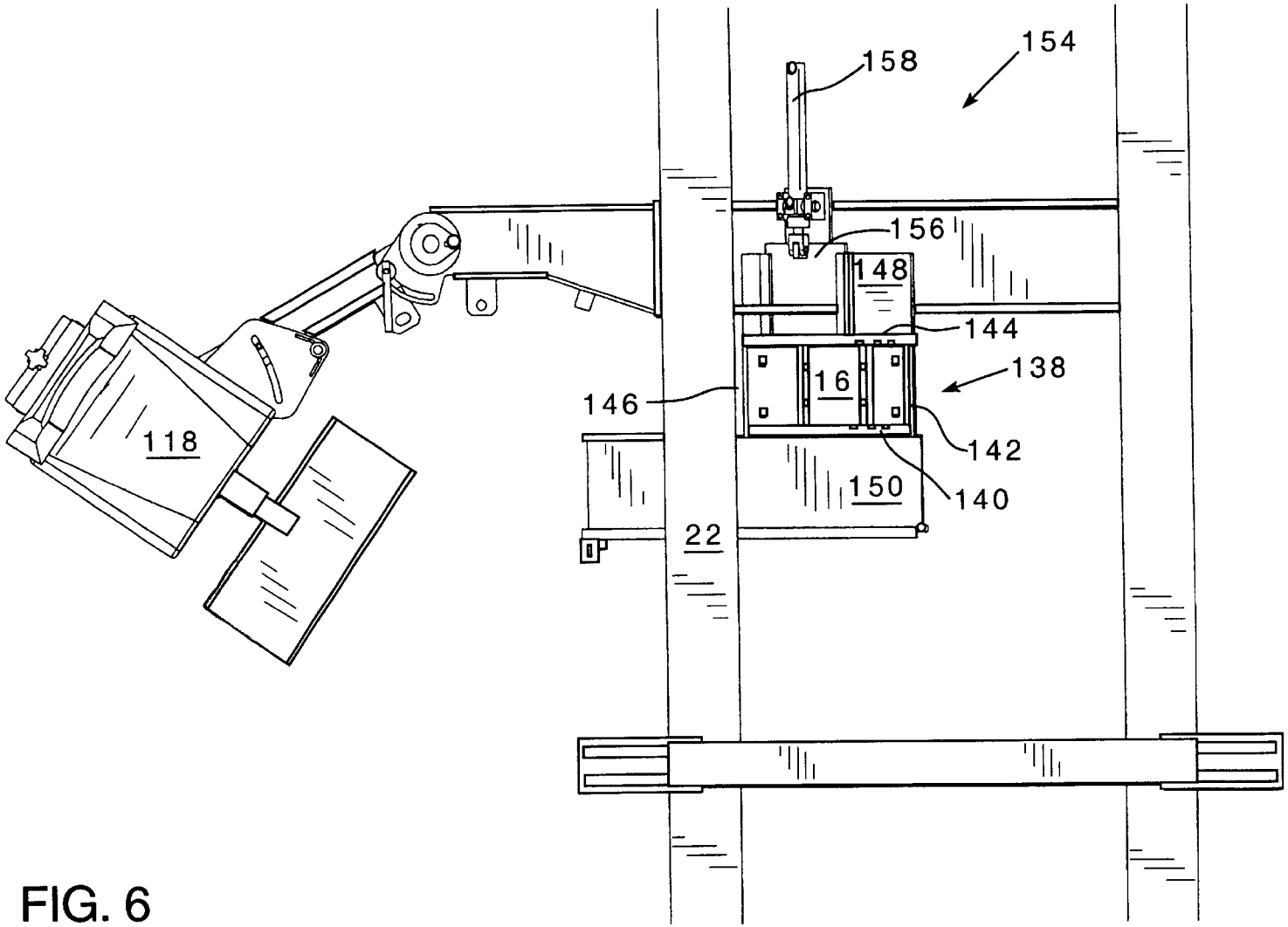
FIG. 6 is a top view of an operator's chair and tie plate magazine for a railway tie plate insertion vehicle according to the present invention.

Referring to FIGS. 4–5, a typical railway 10 includes pair of rails 12 supported by ties 14. The ties 14 are typically imbedded in ballast to prevent their movement. A tie plate 16 fits between the rail 12 and the tie 14, with a plurality of spikes passing through the tie 14 and tie plate 16, and having their heads overlap the bottom flange of the rail 12. The spikes and tie plate 16 thereby secure the rail 12 against transverse movement. A rail anchor 19 fits on either side of the tie 14, and is generally secured to the gauge side or the rail 12. The rail anchor 19 prevents longitudinal movement of the rail 12 with respect to the tie 14. The top surface of the rail 12 forms the rail's ball 20, which supports the wheels of railway vehicles. Adjacent sections of rail 12 may be joined using joint bars 21.

During a tie 14 replacement operation, it is necessary to replace the tie plates 16. The present invention is directed towards the insertion of new tie plates 16 between the rails 12 and ties 14.

Figure 1:
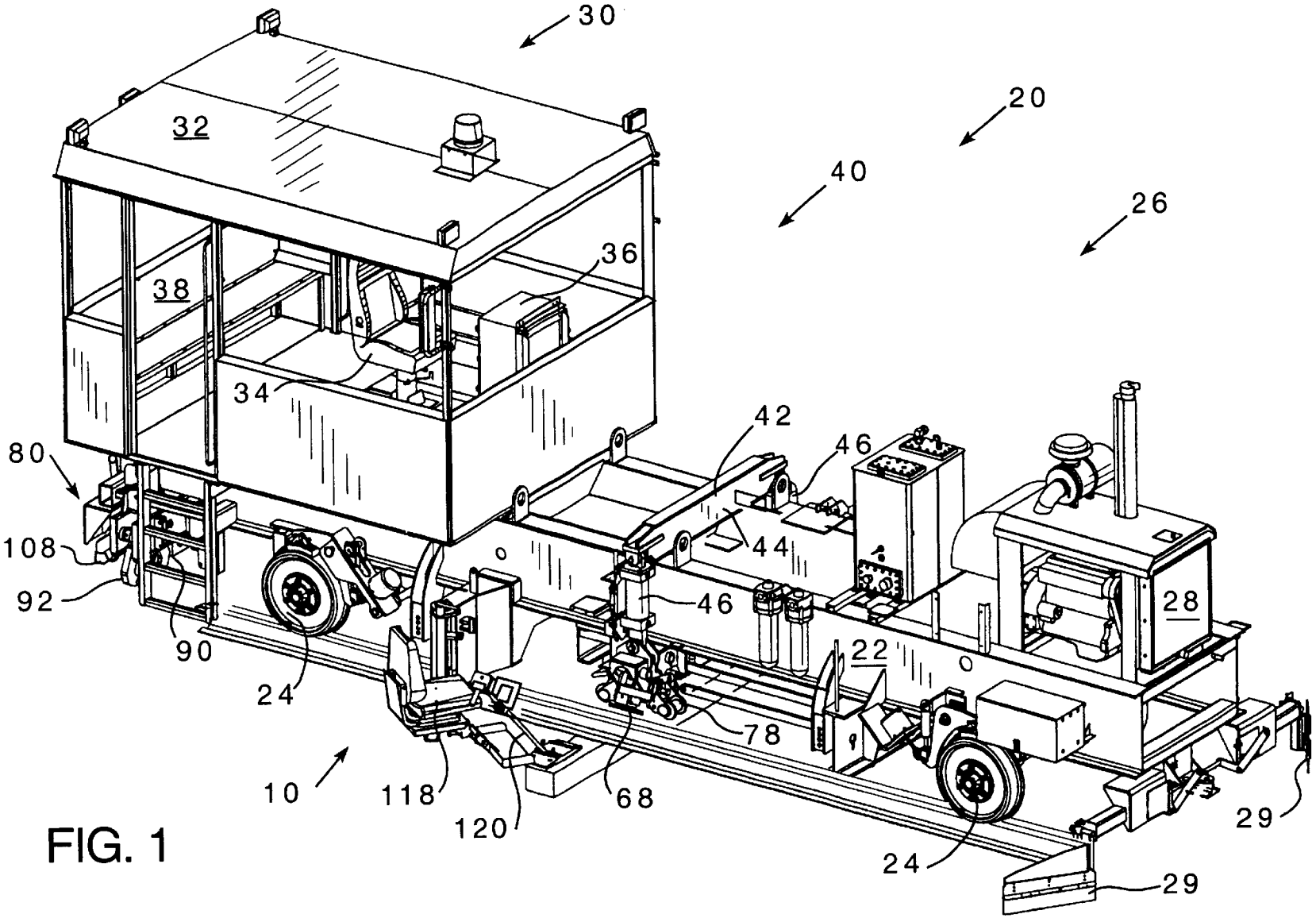
FIG. 1 is an isometric view of a railway tie plate insertion vehicle according to the present invention.

Referring to FIG. 1, the vehicle 20 includes a chassis 22, supported by a plurality of wheels 24. The front 26 of some preferred embodiments includes a motor 28 for propelling the vehicle 20. The front 26 may also include a fuel tank, a hydraulic fluid tank, hydraulic fluid pump, and other components necessary to operate the vehicle 20. The front 26 may also include a ballast plow 29. The back 30 of the vehicle 20 includes a cab 32, containing a driver's chair 34, vehicle controls 36, and a passenger bench 38.

Figure 2:
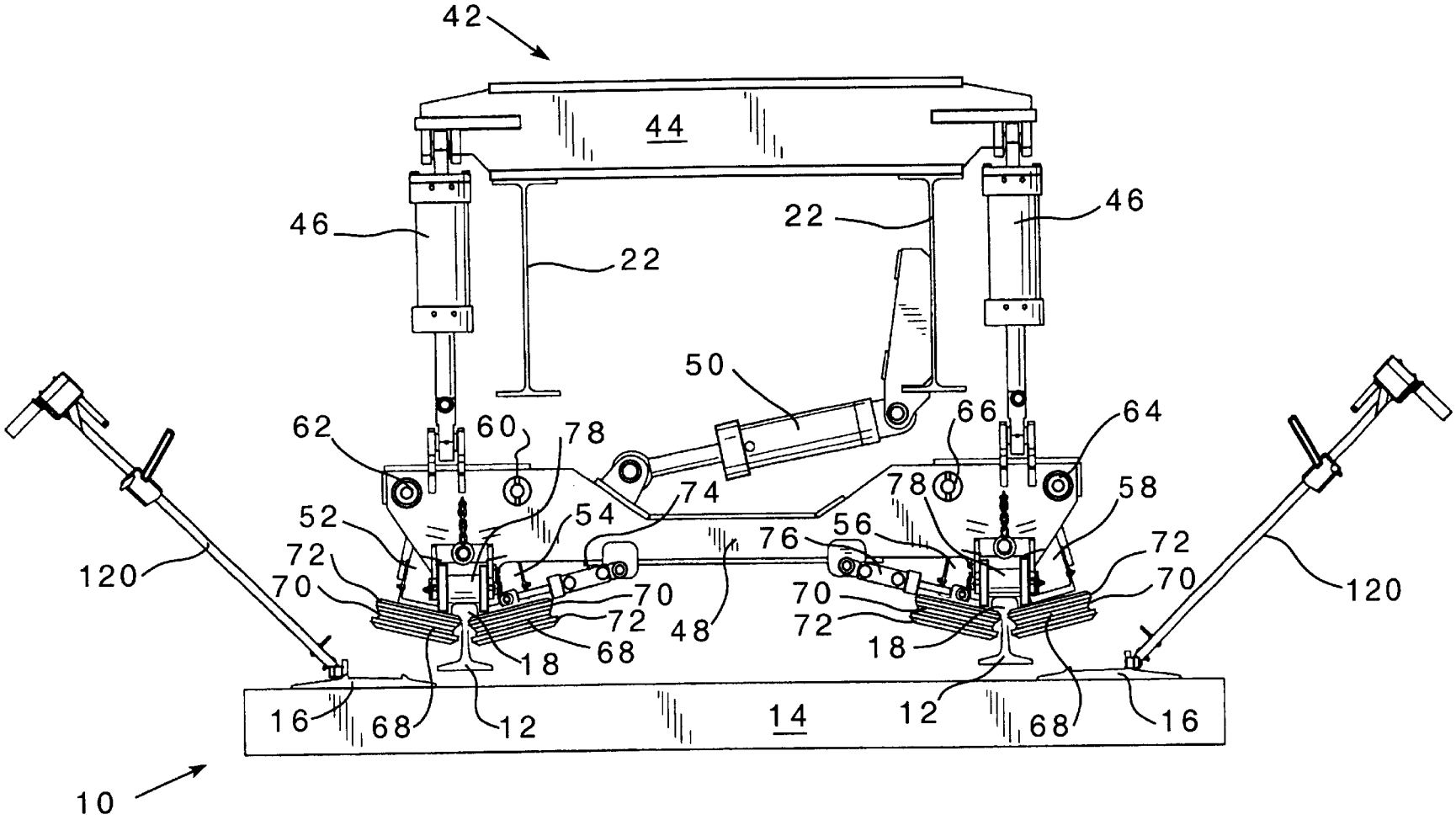
FIG. 2 is a front view of a rail clamp and a pair of tie plate insertion wands, according to the present invention.

The center portion 40 of the vehicle 20 includes a rail clamp assembly 42, for lifting the rails 12 a sufficient distance to permit insertion of a tie plate 16, which will typically be approximately one to two inches. The rail clamp assembly 42 is best illustrated in FIG. 2. The rail clamp assembly includes a crossbeam 44, secured to the top of the chassis 22. A hydraulic cylinder 46 depends from each end of the crossbeam 44. The hydraulic cylinders 46 support a lower crossbeam 48 at their bottom ends. A stabilizer cylinder 50 extends between the chassis 22 and the lower crossbeam 48, with the cylinder 50 oriented in a substantially horizontal direction, and substantially perpendicular to the rails 12, although some deviation is permissible. A pair of clamping arms 52, 54 depend from one end of the lower cross beam 48, and a mirror image pair of clamping arms 56, 58 depend from the other end of the lower cross beam 48. The clamping arms 52, 54, 56, 58 are pivotally mounted to the lower cross beam 48 at pivots 60, 62, 64, and 66, respectively. The clamping arms 52, 54 cross over each other, opening and closing with a scissors-like action. Likewise, clamping arms 56, 58 also cross over each other, opening and closing with a scissors-like action. Each of the clamping arms 52, 54, 56, 58 terminates in a roller 68, which defines a circumferential channel 70 between a pair of raised edges 72. The channel 70 and raised edges 72 are dimensioned and configured so that the rollers 68 may engage a rail 12 with the entire roller 68 below the rail's ball 18 (most commonly used), or with the rail's ball 18 within the channel 70 (useful when engaging a rail 12 above the joint bars connecting adjacent rails 12). Hydraulic cylinders 74, 76 are connected between the lower cross beam 48 and clamping arms 54, 56, respectively, for opening and closing the clamp 42. A roller 78 is provided between each pair of arms 52, 54, and 56, 58, where it will sit on top of the rail's ball 18 when the rollers 68 are under the ball 12.

Figure 3:
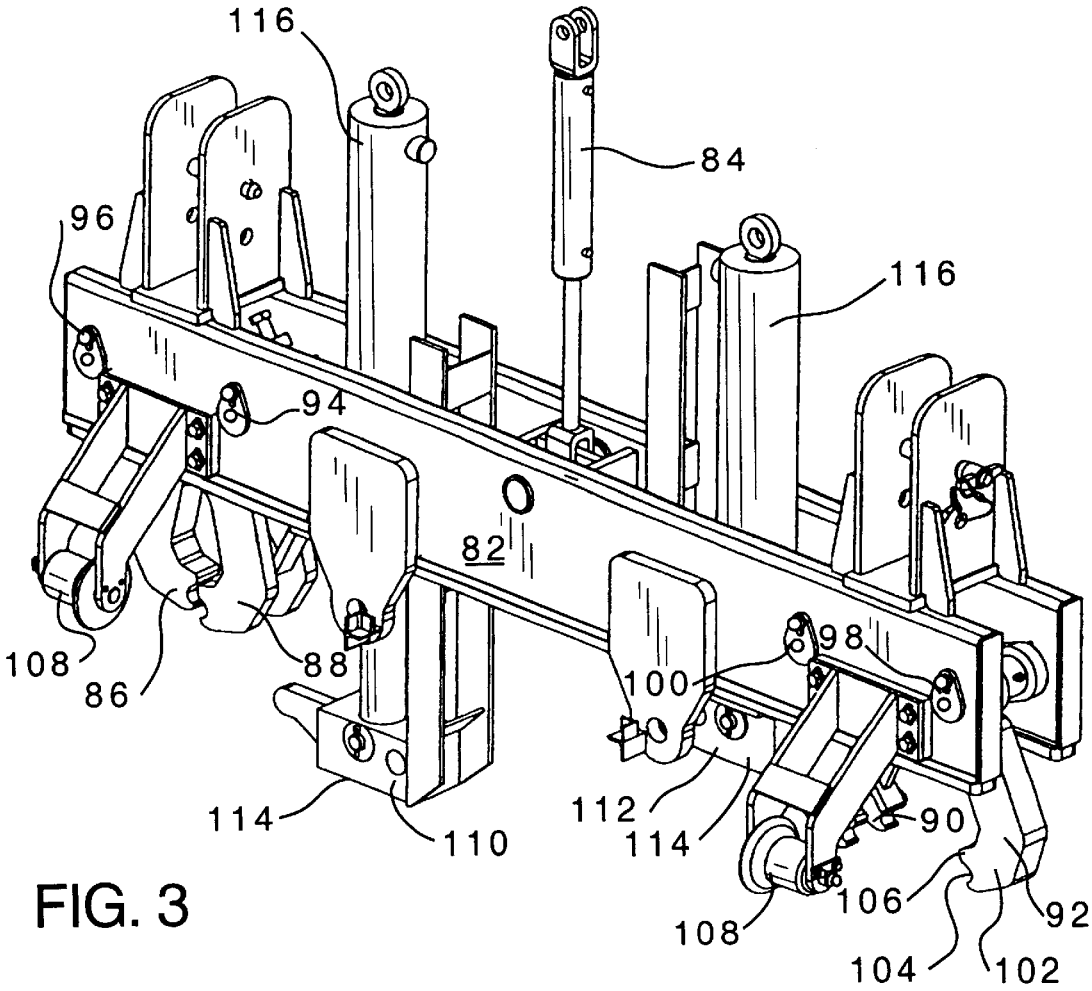
FIG. 3 is an isometric view of a rail clamp according to the present invention, illustrating the clamp on one side open, and the clamp on the other side closed.

Referring to FIGS. 3–4, some preferred embodiments of the present invention may include a second clamp 80, located at the back 30 of the vehicle 20. The second clamp assembly 80 is in many respects similar to the first clamp assembly 42. The clamp assembly 80 includes a cross beam 82, which may be raised and lowered using a hydraulic cylinder 84, connected between the cross beam 82 and the chassis 22. A pair of clamping arms 86, 88 depend from one end of the crossbeam 82, and a mirror image pair of clamping arms 90, 92 depend from the other end of the cross beam 82. The clamping arms 86, 88, 90, 92 are pivotally secured to the crossbeam 82 at pivots 94, 96, 98, 100, respectively. The clamping arms 86, 88 thereby cross over each other, and will open and close with respect to each other using a scissors-like action. Likewise, the clamping arms 90, 92 also cross over each other, and will open and close with respect to each other using a scissors-like action. Each clamping arm 86, 88, 90, 92 terminates in a clamping tip 102, defining a horizontal channel 104 thereon, between a pair of raised edges 106. The channel 104 and raised edges 106 are dimensioned and configured so that the entire clamping tip 102 may fit below the rail's ball 18 (the normal grasping position), and so that the ball 18 may fit within the channel 104 (when clamping a rail 12 above a joint bar joining adjacent rail sections 12). A roller 108 also depends from the cross beam 82, and is dimensioned and configured to engage the top of the rail's ball 18 when the clamping tips 102 are beneath the rail's ball 18. The clamp assembly 80 also includes a pair of pusher arms 110, 112, with one pusher arm 110 located adjacent to the clamping arms 86, 88, and the other pusher arm 112 located adjacent to the clamping arms 88, 90. The pusher arms 110, 112 each terminate in a foot 114 dimensioned and configured to engage the top of a tie 14. The pusher arms 110, 112, are mounted for vertical sliding movements with respect to the cross beam 82, with the position of each pusher arm 110, 112 controlled by a hydraulic cylinder 116.

Figure 7:
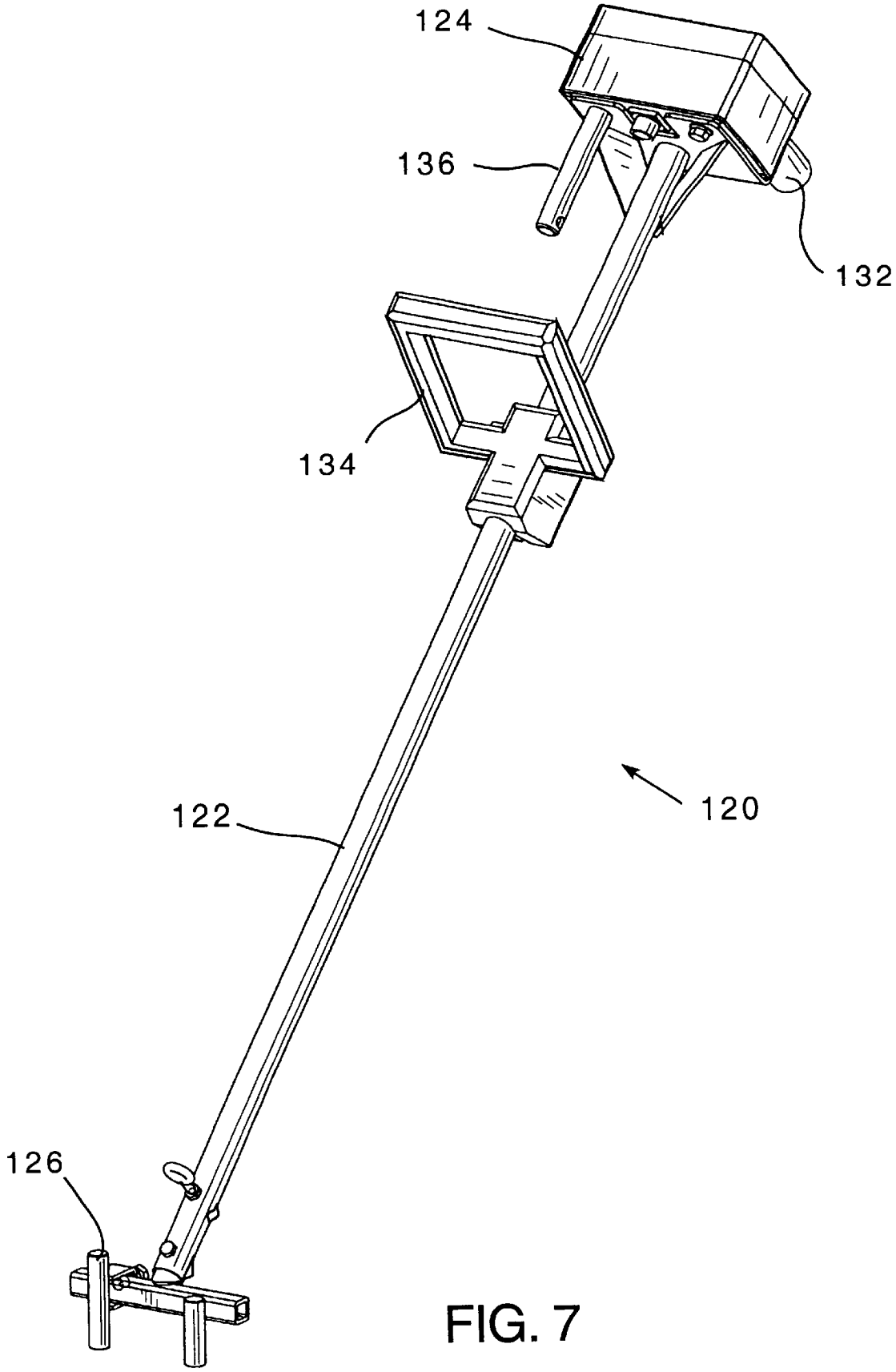
FIG. 7 is an isometric view of a tie plate insertion wand according to the present invention.
Figure 8:
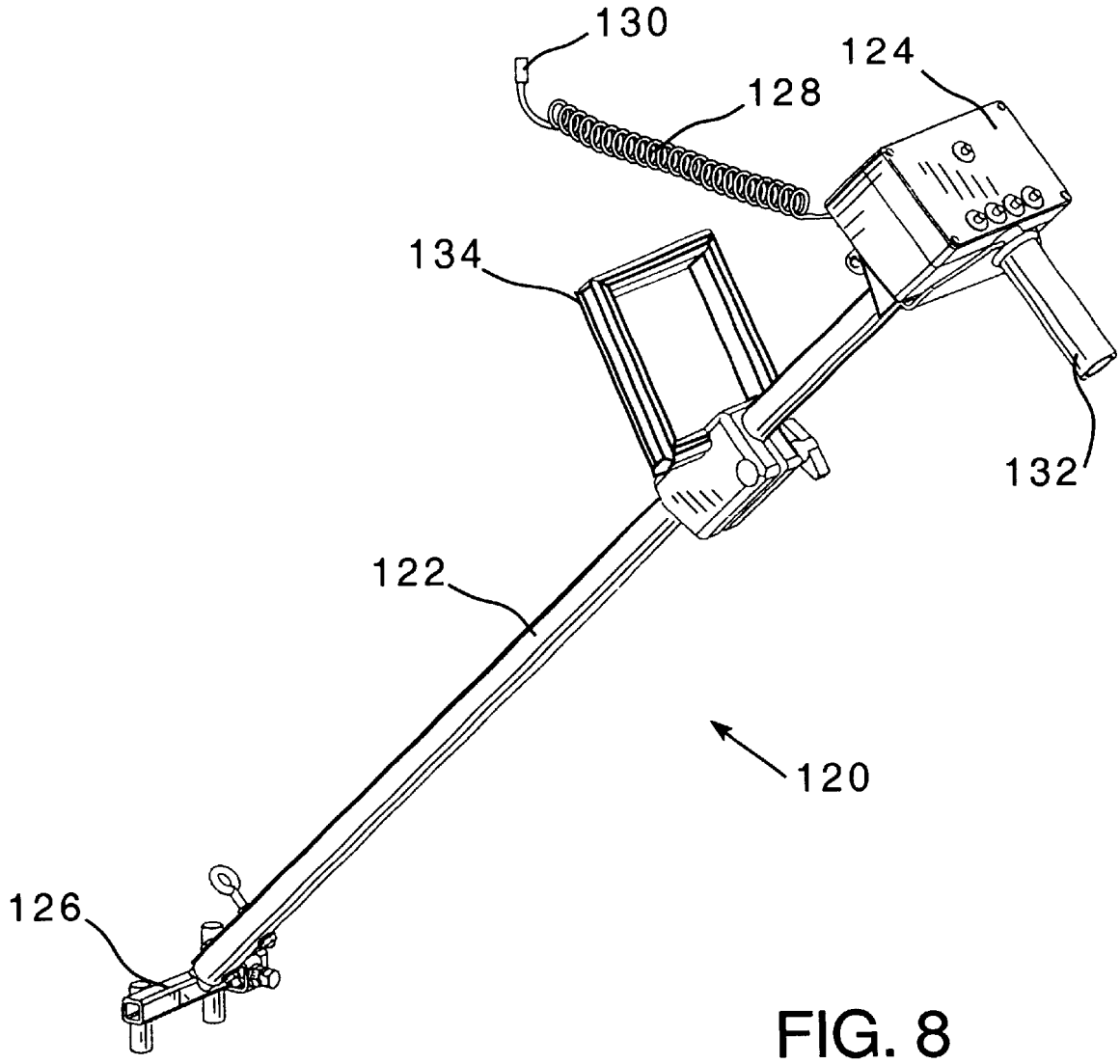
FIG. 8 is an isometric view of a tie plate insertion wand according to the present invention.

The center portion 40 of the vehicle 20 also includes an operator's chair 118 on either side. Each operator's chair 118 is provided with a tie plate insertion wand 120. The tie plate insertion wand 120 is best illustrated in FIGS. 7–8. The tie plate insertion wand 120 includes a pusher rod 122 having a control box 124 at its upper end and a foot 126 at its lower end, dimensioned and configured to facilitate pushing a tie plate 16. Many preferred embodiments of the control box 124 include all controls necessary to operate the vehicle 20, including propelling the vehicle 20, apply the brakes, activate the emergency stop and shutdown mechanism, blow the vehicle's horn, operating the tie clamp assemblies 42, 80, adjust the rail lift on their individual sides, and dispensing a tie plate 16 from a tie plate magazine (described below). A cable 128, preferably terminating in a quick disconnect 130, provides for electrical connection between the control box 124 and the vehicle 20, thereby permitting the transmission of control signals therebetween. The quick disconnect 130 permits the tie plate insertion wand 120 to be moved from the vehicle's central portion 30, wherein it may be used from an operator seated within the chair 118, to the back 30 of the vehicle 20, wherein it may used by someone following the vehicle 20. The tie plate insertion wand 120 may include handles 132, 134, 136 to facilitate manipulation of the tie plate insertion wand.

Figure 9:
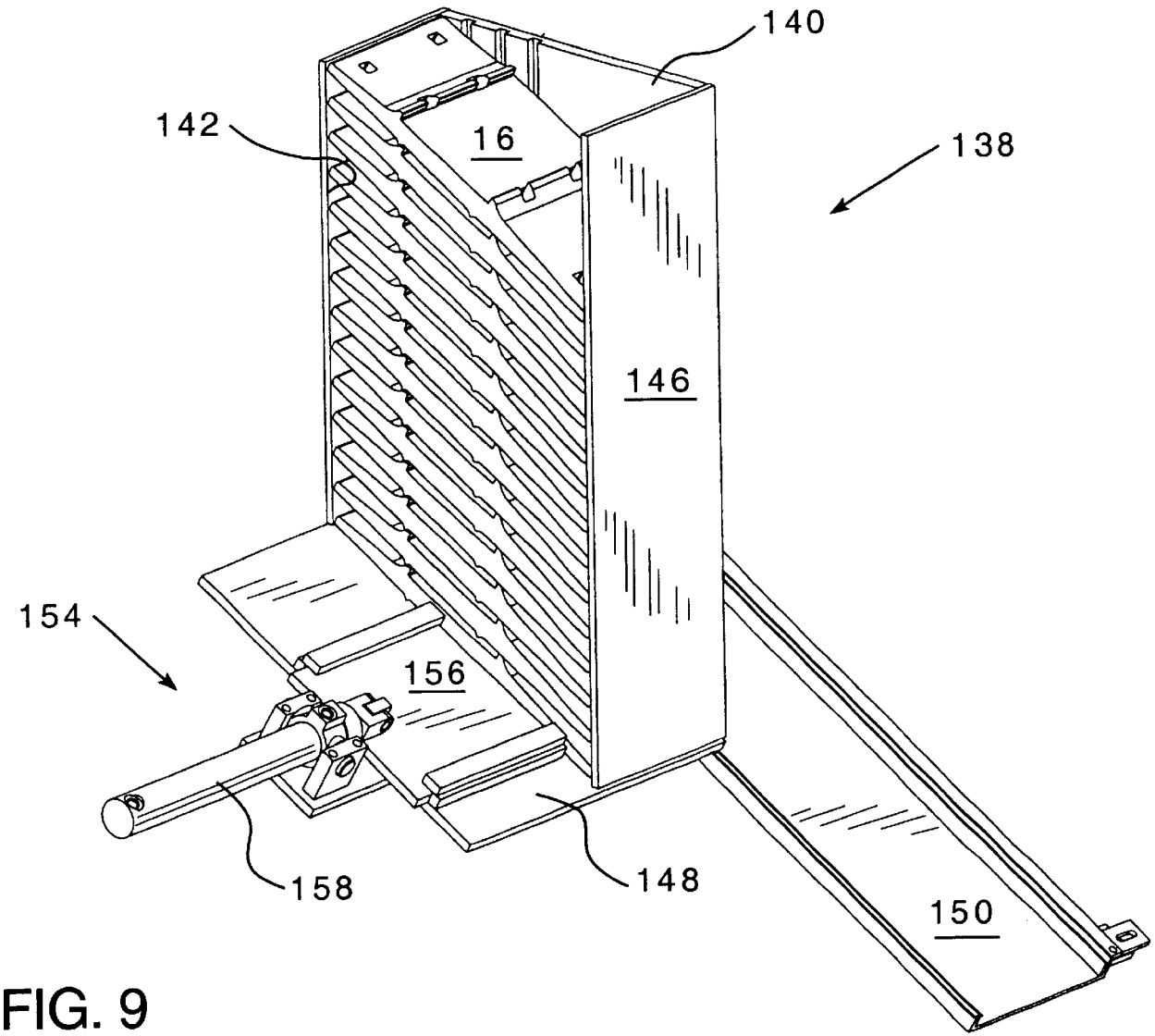
FIG. 9 is an isometric view of a tie plate magazine according to the present invention.
Figure 10:
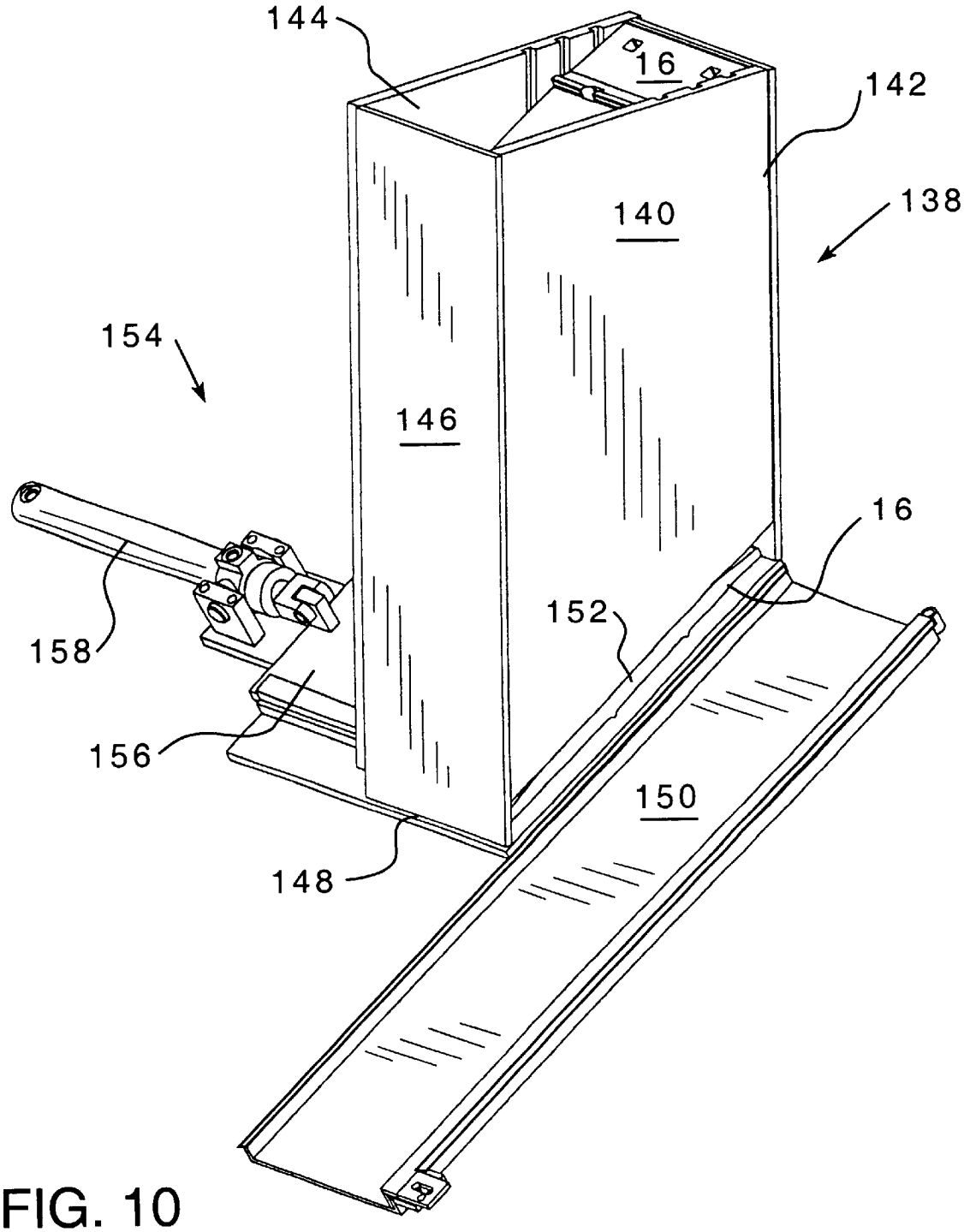
FIG. 10 is an isometric view of a tie plate magazine according to the present invention.

Referring to FIGS. 9–10, the vehicle 20 may also include a tie plate magazine 138. The tie plate magazine 138 includes four sidewalls 140, 142, 144, 146, and an angled bottom 148. A ramp 150, having approximately the same angle as the bottom 148, is positioned with its top end directly adjacent to the bottom 148. The bottom end of the ramp 150 terminates just above the level of the ties 14. A slot 152 within the sidewall 140 is dimensioned and configured to permit passage of the lower-most tie plate 16 within the magazine 138 from the magazine 138 to the ramp 152. A tie plate pusher assembly 154 is provided for pushing the lower-most tie plate 16 from the magazine 138 to the ramp 150. The pusher assembly 154 includes a pusher 156, and a hydraulic cylinder 158 secured between the pusher 156 and vehicle chassis 22.

In use, the vehicle 20 will be driven to the railway section upon which repairs are needed, with the work crew riding in the cab 32. When the work site is reached, two operators will exit the cab 32, sitting the chairs 118. They will secure the quick disconnect 130 of their tie plate insertion wands 120 to the mating quick disconnects in the central portion 40 of the vehicle 20, thereby permitting them to control the vehicle from the chairs 118 instead of the cab 32. When the operators are using the chairs 118, the main tie clamp assembly 42 will be utilized, with the secondary tie clamp assembly 80 left in its open and raised travel position. The cylinders 46 will be extended until the rollers 68 are located on either side of the rail 12, directly beneath the rail's ball 18 of each rail 12. The hydraulic cylinders 74, 76 will be extended, thereby securing the clamp assembly 42 in this position. The rollers 68 will permit the clamp assembly 42 to roll along the rails 12 in a clamped but relaxed configuration until a location is reached wherein a tie plate 16 needs to be replaced.

The operators will use the control boxes 124 to drive the vehicle 20, stopping the vehicle 20 so that its central portion 40 is aligned with the tie 14 for which the tie plate 16 must be replaced. Again using the control boxes 124, the operators will retract the cylinders 46, thereby lifting the rails 12 approximately one to two inches above the tie 14. The scissor arms 52, 54, 56, 58 will be clamped more tightly around the rail 12 through the combination of this lifting motion and their scissoring action. Typically, a new tie plate 16 will previously have been deposited in a location along side that wherein it will be installed. In the event that a tie plate 16 was not previously deposited, the operator on the side of the vehicle 20 wherein the tie plate 16 is missing will utilize his control box 124 to actuate the hydraulic cylinder 158 of the tie plate pusher 154, thereby dispensing a tie plate 16 from the magazine 138 to the ramp 150. The tie plate 16 will then descend the ramp 150 under its own weight, thereby being deposited in close proximity to its final desired location under the rail 12. In either case, the operator will use the tie plate insertion wand 120 to manually push the tie plate 16 into its proper location between the tie 14 and rail 12. Again using the control box 124, the operators will extend the cylinders 46, thereby lowering the rails 12 onto the tie plates 16. The operators will then drive the vehicle 20 to the next location wherein a tie plate 16 must be replaced.

In some instances, it may be desirable or necessary to insert a tie plate 16 from the gauge side of the rail 12 instead of from the field side. Examples of such situations include locations next to curve blockers or elevated platforms, or possibly on a bridge. Additionally, the secondary clamp assembly 80 provides redundancy in case problems developed with the primary clamp assembly 42. To use the secondary clamp assembly 80, the operators will detach the quick disconnect 130 of the tie plate insertion wands 120 from the central portion 40 of the vehicle, connecting them to identical mating quick disconnect portions at the back 30 of the vehicle 20. Once the vehicle 20 is in a location wherein a tie plate 16 must be replaced, the clamp assembly 80 is lowered until the rollers 108 contact the rail 12, and then the arms 86, 88, 90, 92 are closed around the rails 12. The hydraulic cylinders 116 are extended, thereby pushing the arms 110, 112 downward, raising the clamp assembly 80, thereby lifting the rails 12. This lifting action, combined with the scissor mechanism of the arms 86, 88, 90, 92, tightens the grip of the arms 86, 88, 90, 92 on the rails 12 as the clamp assembly 80 is lifted. As before, the operators will use the tie plate insertion wands 120 to push the tie plates 16 into position between the rails 12 and ties 14. If a tie plate was not deposited in the proper location prior to commencing this task, a tie could be dispensed from the tie plate magazine 138, which ideally should be done from the central portion 40 of the vehicle 20, before the back 30 of the vehicle 20 reaches the exact work location. Once the tie plates 16 are properly positioned, the operators use the control boxes 124 to lower the clamp assembly 80, and open the clamping arms 86, 88, 90, 92.

While a specific embodiment of the invention has been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the appended claims and any and all equivalents thereof.

What is claimed is:

1. A railway tie plate insertion vehicle, the vehicle having a chassis defining a front, back, and pair of sides, said vehicle comprising:

an operator's chair extending from each of said sides;

a tie plate insertion wand, comprising:

a pole dimensioned and configured to permit an operator seated in said operator's chair to push a tie plate under a rail;

controls for operating said vehicle; and an electrical connection between said controls and said vehicle for transmitting control signals between said controls and said vehicle.

2. The vehicle according to claim 1, wherein said electrical connection further comprises a quick disconnect, dimensioned and configured for repeated connection to and disconnection from said vehicle.

3. The vehicle according to claim 1, wherein said controls of said tie plate insertion wand include at least one control selected from the group consisting of propelling said vehicle, applying brakes of said vehicle, activating an emergency stop mechanism, blowing a horn of said vehicle, operating a rail clamp, and dispensing a tie plate from a tie plate magazine.

4. The vehicle according to claim 1, further comprising a first rail clamp comprising a pair of scissor arms, each scissor arm having an end.

5. The vehicle according to claim 4, further comprising a roller at the end of each scissor arm, said roller being dimensioned and configured to engage a rail of a railway below a ball of a rail.

6. The vehicle according to claim 4, wherein said rail clamp further comprises a stabilizer cylinder for maintaining and adjusting a rail's lateral position.

7. The vehicle according to claim 4, further comprising a second rail clamp, said second rail clamp having a pair of scissor arms for engaging a rail below a ball of a rail.

8. The vehicle according to claim 7, wherein:

said first rail clamp is located between said wheels of said vehicle; and said second rail clamp is located at said back of said vehicle.

9. The vehicle according to claim 1, further comprising at least one tie plate magazine.

10. The vehicle according to claim 9, wherein said at least one tie plate magazine comprises:

a body, including a bottom;

a ramp directly below and adjacent to said body, said ramp forming a substantially continuous surface with said bottom, said ramp extending to a position adjacent a rail; and a pusher dimensioned and configured to push a tie plate from said bottom onto said ramp.

11. A tie plate insertion wand for use with a tie plate insertion vehicle, the vehicle having a pair of sides, with an operator's chair extending outward from each of said sides, said tie plate insertion wand comprising:

a pole dimensioned and configured to permit an operator seated in said operator's chair to push a tie plate under a rail;

controls for operating the tie plate insertion vehicle; and an electrical connection between said controls and the vehicle for transmitting control signals between said controls and the vehicle.

12. The tie plate insertion wand according to claim 11, wherein said electrical connection further comprises a quick disconnect, dimensioned and configured for repeated connection to and disconnection from said vehicle.

13. The tie plate insertion wand according to claim 11, wherein said controls of said tie plate insertion wand include at least one control selected from the group consisting of propelling the vehicle, applying brakes of the vehicle, activating an emergency stop mechanism, blowing a horn of the vehicle, operating a rail clamp, and dispensing a tie plate from a tie plate magazine.

* * * * *